US008450935B2

(12) United States Patent
Neuman

(10) Patent No.: US 8,450,935 B2
(45) Date of Patent: May 28, 2013

(54) CONTROLLER CIRCUIT FOR HALF WAVE LED LIGHT STRINGS

(75) Inventor: Robert C. Neuman, Cannon Falls, MN (US)

(73) Assignee: Seasonal Specialties, LLC, Eden Prairie, MN (US)

( * ) Notice: Subject to any disclaimer, the term of this patent is extended or adjusted under 35 U.S.C. 154(b) by 550 days.

(21) Appl. No.: 12/687,278

(22) Filed: Jan. 14, 2010

(65) Prior Publication Data

US 2011/0148311 A1 Jun. 23, 2011

Related U.S. Application Data

(60) Provisional application No. 61/289,578, filed on Dec. 23, 2009.

(51) Int. Cl.
*H05B 37/00* (2006.01)

(52) U.S. Cl.
USPC ..... 315/207; 315/200 A; 315/200 R; 315/185 A; 315/312

(58) Field of Classification Search
USPC ..... 315/185 S, 312–326, 209 R, 119–128, 315/200 R, 201–208, 200 A
See application file for complete search history.

(56) References Cited

U.S. PATENT DOCUMENTS

| | | | | |
|---|---|---|---|---|
| 5,357,697 | A | 10/1994 | Lin | |
| 5,546,032 | A | 8/1996 | Yatagai | |
| 2008/0018260 | A1 | 1/2008 | Janning | |
| 2008/0129213 | A1 | 6/2008 | Janning | |
| 2008/0129214 | A1 | 6/2008 | Janning | |
| 2009/0091263 | A1 | 4/2009 | Janning | |
| 2009/0128042 | A1 | 5/2009 | Janning | |
| 2009/0129077 | A1 | 5/2009 | Janning | |
| 2009/0167190 | A1 * | 7/2009 | Hickey | 315/129 |
| 2011/0309757 | A1 * | 12/2011 | Weaver et al. | 315/188 |

* cited by examiner

*Primary Examiner* — Tuyet Thi Vo
(74) *Attorney, Agent, or Firm* — Altera Law Group, LLC

(57) ABSTRACT

A series connected light string using LEDs connected to an AC power source is disclosed. In order to make some or all of the lights color change, twinkle, and/or flash, controllers are provided in series with all or some of the LEDs. Because the supply source AC, but the active elements are essentially rectifiers, the circuit becomes a half wave DC circuit. Half wave DC will cause unpredictable behavior in DC circuit components. This will cause the controller to shut down during the zero voltage portion of the pulsating DC cycle. To prevent this a current supplying element is placed in parallel with the controller.

9 Claims, 3 Drawing Sheets

CONTROLLER CIRCUIT FOR HALF WAVE LED LIGHT STRINGS

CROSS-REFERENCE TO RELATED APPLICATION

This application claims the benefit of US Provisional Application No. 61/289,578 filed 23 Dec. 2009, which hereby are incorporated herein by reference in its entirety.

BACKGROUND

In the past, decorative light strings used a plurality of series or parallel connected incandescent lights. To make one or more of them flash or twinkle, a bimetallic strip was used to either respectively open circuit or short out the filament, or a partial resistive shunt would be applied across the light terminals with a switching circuit to dim or in effect extinguish the bulb.

These dimming circuits were typically not polarity sensitive so they could operate effectively on AC circuits.

With the advent of low cost Light Emitting Diodes (LEDs) especially when they became available in different colors, have caused the decorative light industry to move toward these lower wattage, lower temperature devices. Unfortunately, the circuitry for creating light effects such as flashing, twinkling, shimmering, color changing (such as for LEDs which change color upon application of different voltages or polarities), or the like require more sophisticated controllers to achieve what previously could be done with simple electromechanical solutions.

Furthermore, LED devices are essentially rectifiers in series or parallel which results in problematic results for other devices which require full wave DC when the LEDs on an AC circuit create half wave rectification.

If an LED is removed from the circuit, there are known methods for maintaining the rest of the string illuminated but these methods can sometimes interfere with other features of the light string.

Finally, cost is a critical factor. Whatever solution is required to make the transition from incandescent to LED lighting must maintain the low cost nature of incandescent bulbs.

The present invention addresses these issues.

SUMMARY

The present invention is summarized below, for the convenience of the reader, but this is not a complete presentation of the inventive concepts. One must read the claims and the full specification to understand the scope of the invention.

According to one aspect of the disclosure there is an LED light string having a plurality of LEDs connected to an AC circuit; the LEDs being wired in series in uniform polarity. At least one of said LEDs intended for flashing including a controller; said controller being wired in series with said at least one LED and providing on-off switch of current therethrough, thereby causing its series connected LED to flash in response to switching of the controller, a current supplying element connected in parallel with said controller and in series with the LED; said element supplying current to said controller to maintain said controller operational at least for a predetermined period of time when no current is supplied by the AC circuit. In one embodiment the element is a capacitor.

There is also disclosed a method of building an LED light string (typically series wired) circuit supplied by AC power wherein at least one of the LEDs can flash, twinkle, or change colors comprising the steps of connecting a plurality of LEDs in series with uniform polarity end to end, including in said LED series at least one LED intended for flashing, said flashing LED including a series connected controller element capable of switching on and off in response to predetermined settings; attaching a current supplying element in parallel with said controller element and in series with said flashing LED, so that when no power is supplied to the controller during half of the AC power cycle, said current supplying element will maintain the operation of the controller.

There is also disclosed a flashing LED unit intended for use with a half wave rectified AC power source comprising a socket having a pair of separated contacts, an LED; an LED power controller connected in series with the LED; current supplying element connected in parallel with said LED power controller and being electrically integrated to each other, so that removal of the controller from the socket simultaneously removes the current supplying element.

BRIEF DESCRIPTION OF THE DRAWINGS

Full understanding of the drawings can be had when they are viewed in connection with the specification and claims.

DETAILED DESCRIPTION

Figure 1:
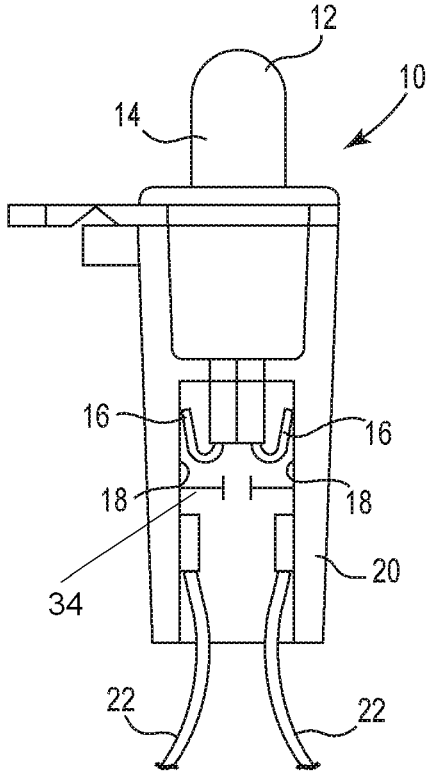
FIG. 1 is an example of a light socket, LED and capacitor in parallel therewith.

Light emitting diode (LED) light strings are now commonly used for decorative purposes. A flashing effect, such as "twinkling" was commonly provided in incandescent light strings by the use of bi-metal flasher bulbs which used the shunting effect of a heat responsive bi-metallic strip to shunt, fully or partially, the tungsten filament of that bulb. In a flashing set a flashing bulb was used where the effect of the heat responsive bi-metal strip was to open the circuit of the tungsten filament of the bulb.

With LED lighting, shunting or open circuiting of the bulb is still possible but not by the use of heat responsive elements because LED produce very little heat.

To replace the bi-metal shunt switch, electronic Controllers are known in the art. LEDs with controllers are available from any sources, such as part RL5-RGB-ACC available from Superbrightleds.com 400 Earth City Expressway, St. Louis, Minn. 63045 or LED5 RGBCC from The LED Light, Inc 1617 Fairview Drive Step 27-28, Carson City Nev. 89701 but such devices expect to be supplied by pure DC sources so that they don't reset. Discrete controller components are also shown in U.S. Pat. Nos. 5,357,697 and 5,546,032. In general, these controllers are solid state devices which provide an internal switching shunt, or partial bypass with resistance or solid state components like zener diode, depending upon the twinkle effect desired, across the LED to which it is attached. The controller may also alter the voltage or current to the LED thereby causing its series connected LED to change its illuminating characteristics in response. The change can be more than on/off or bright/dim but flashing rates, color changes etc. Thus with the use of a controller, it is possible to have any or all lights in an LED string to twinkle, flash or emit any light pattern or color desired.

It is possible to mount the controller internal or external to the LED. It can be wired in series or parallel. In parallel it has a shut action. In series, it is a circuit interrupter. The wiring series/parallel is trivial and known in the art.

The controller must have a low power filtered DC voltage to work continuously. If the voltage drops to zero, or less, the controller will shut off. The least expensive design of a standard LED string light has no transformer or rectifier (since the LEDs themselves are half wave rectifiers) and are designed to be plugged into an AC wall outlet. This produces a half wave DC output across the LED, also referred to as pulsed, DC. In this pulsed DC cycle the voltage is positive for half its cycle and has zero volts for the other half. It is this zero volt portion of the cycle which is problematic. During the zero portion, the controller has no current to maintain its operation. In most cases, the controller resumes from a restart point when current reappears in the positive voltage portion of the cycle. The results are at best, unpredictable, and at worst, the LED never starts or never turns off, depending on the restart sequence of the controller. In reality the controller itself is turning on, and off again before it can turn on the LED.

To solve this problem, I have found that providing a current supply across the controller will maintain the controller during the off (zero) cycle of the half wave rectified supply.

One solution to providing this current supply is by adding the right size capacitor and the pulsed DC signal can be smoothed out, also known as filtered, never reaching a zero voltage state. With the DC voltage filtered the controller will not shut off or reset and therefore can control the blinking of the LED.

Adding a small capacitor across the positive and negative connections causes the pulsed DC voltage to be filtered which keeps the controller working. Also by using a small capacitor at the LED, one can avoid an expensive larger capacitor that would be required across the entire circuit of LEDs and the associated cost of housing it to meet regulatory requirements. Instead by having small capacitors at each LED they are easily incorporated into the LED, onto the LED leads, in the lampholder, or outside the lampholder.

During the positive half of the pulse cycle the capacitor stores some of the DC voltage. During the zero voltage half of the cycle the capacitor releases its stored power back to the Anode side of the LED. By storing and releasing the power, the LED and controller never fully loses power or goes into reset mode. This solution is primarily intended for LED light strings, but it will work equally well with incandescent strings or mixed LED/incandescent strings which have pulsating DC power.

Turning to the figures, FIG. 1 shows an exemplary LED light socket 10 typically used in a light string. The LED 12 can have a translucent domed portion 14 (or many other shapes) and a base (not shown) typically of an epoxy or other polymer material. The LED 12 has leads 16 which make electrical connection with contacts 18 in the base 20 of the socket. The contacts 18 are connected to wires 22 which lead to the rest of the circuit. Other configurations can preclude contacts 18 and have the wires 22 connected directly to the leads 16.

Figure 4:
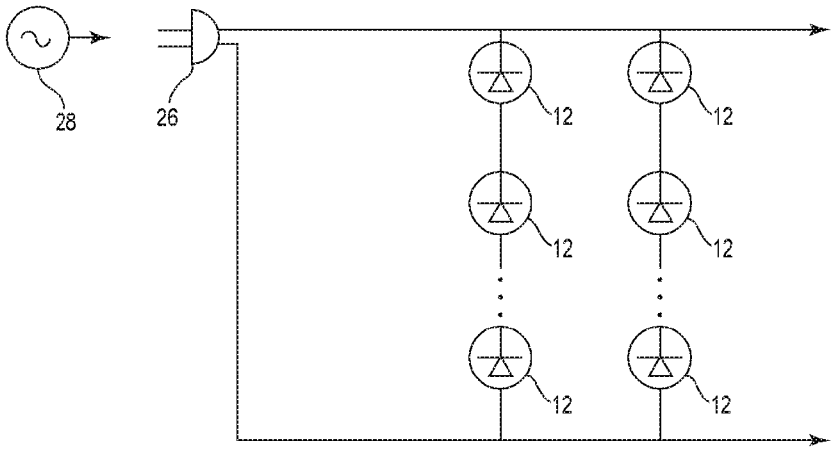
FIG. 4 is a schematic drawing of a pair of LED light strings.

FIG. 4 shows a typical circuit of a plurality of series strings made of LEDs 12 which are connected in parallel and to a plug 26 and an AC power source 28.

Figure 2A:
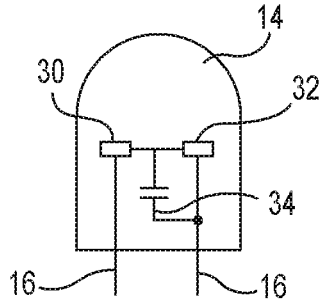
FIG. 2*a* is a schematic drawing of an alternate embodiment to FIG. 2.
Figure 2:
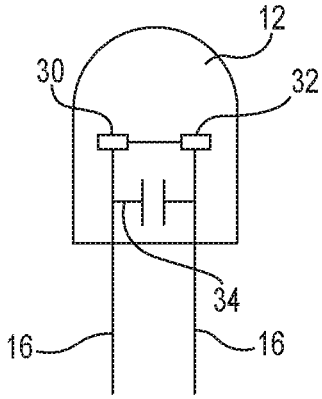
FIG. 2 is a schematic drawing of an embodiment with a LED, controller in series with and a capacitor in parallel, all integrated into the socket.
Figure 3:
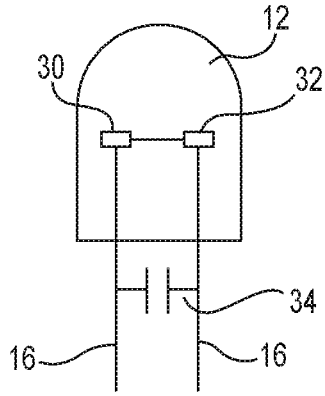
FIG. 3 is an embodiment like FIG. 3 except the capacitor is external to the LED housing.

As can be seen in FIGS. 2, 2*a*, and 3, the LED contains a light emitter portion 30, a controller circuit 32 and a current supply element 34 shown in the preferred embodiment as a capacitor 34. As known in the art, the location of the light emitter 30 and controller circuit 32 can be reversed depending on the circuitry.

Figure 5A:
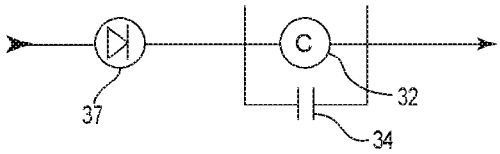
FIG. 5*a* is a schematic drawing of a series diode-controller circuit.
Figure 5:
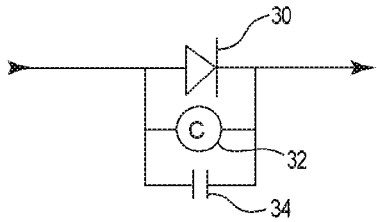
FIG. 5 is a schematic drawing of a parallel diode-control circuit.

FIG. 2 shows a series connected controller with a capacitor bridging the combined light emitter and controller, while FIG. 2*a* shows the capacitor 34 only bridging the controller. The latter is preferred because it will function with a smaller capacitor but more difficult to construct because of placement problems with the capacitor. FIGS. 2 and 2*a* presume that the capacitor will be located within the LED or epoxy housing itself or the socket housing, while FIG. 3 assumes that the capacitor is external to the LED, either in the socket or completely external. Note that in FIGS. 2, 2*a* and 3, the controller 32 and light emitter 30 appear to be in series. These figures are only generalizations. These circuit elements may be in series or parallel as shown in the schematic FIGS. 5 and 5*a*. As mentioned above, the controller in a parallel circuit (FIG. 5) must compensate for the effect of its shunting effect. If several controllers are used in the same circuit and the shut resistance is zero, the remaining LEDs will fail due to over current if they all shunt at the same time, which could occur. A typical shunt resistance is 470 ohms assuming 5 light shunts per string with a maximum of 2 k ohm in total for a 30 light series string. Beyond that, that LED will be dimmed and the remainder will be brighter. The preferred parallel shunt has a current limiting resistor which will still have the same voltage drop than the LED. In the series version (FIG. 5*a*) this is not a problem, but the capacitor must have a sufficiently high voltage rating to withstand several times the normal voltage across the controller. Most importantly, the capacitor may not be left in circuit if the LED or controller is removed (ie it is the only series bridge left in the circuit at that place) unless its voltage rating is at least line voltage (in USA 110-135 v). If the capacitor fails due to over voltage, one cannot predict what will happen. In some cases, the capacitor will be an open circuit, but in others, it will short. Unpredictability is not a good outcome in such a light string construction, so the capacitor should not be used in a way which depends on one of those two outcomes. Therefore the construction of FIG. 1 is not preferred unless the capacitor is molded into the LED carrier 12, so that it is removed with the LED. Furthermore, it is not electrically necessary to have the capacitor 34 wired in parallel with the LED but it may mechanically easier to do so, such as shown in FIG. 2. It is also possible to have another capacitor in parallel with the LED separate from the one in parallel with the controller. A typical capacitor would have a value of 0.1 uf or greater. Larger values, such as 1 uf are not necessary and expensive. This construction is not using the capacitor to pass current thru at times of positive voltage and most controllers require very little current to stay active during the zero voltage cycle.

It is possible for the controller 32 to also include a zener diode in parallel with the LED which passes the current around the LED and controller when the LED is off. This would maintain current to the rest of the light string if that particular LED were to fail.

It will be appreciated, that the concept presented here in can be used in a "plug and play" configuration. That is, and ordinary LED light string with no flashing or twinkling bulbs can be fully retrofit with twinkling LEDs on an individual basis. With the light emitter, controller and capacitor being unitary and at least the capacitor and shunt be simultaneously removable, the standard LED unit can be swapped out for a twinkle unit and the string will function normally.

Figure 6:
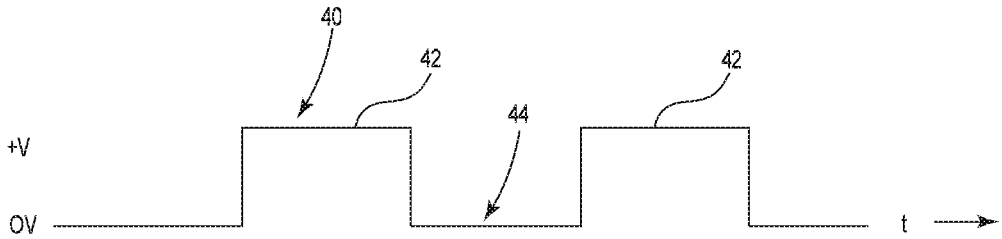
FIG. 6 is a wave form drawing of a half waved rectified DC source.
Figure 7:
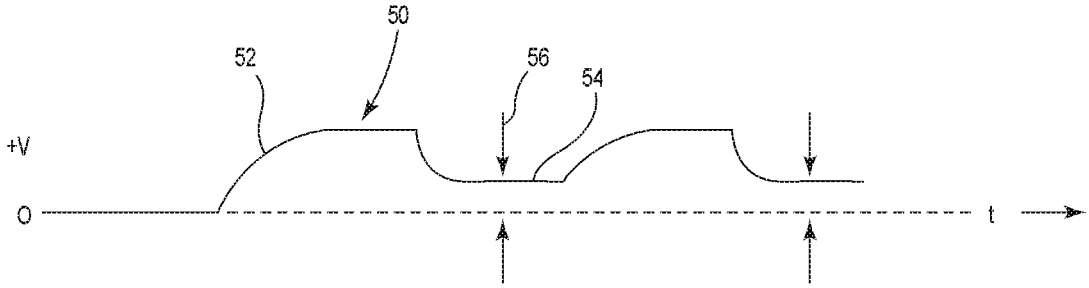
FIG. 7 is a wave form drawing of a half wave rectified DC source as measure across the Controller in FIG. 5.

FIG. 7 illustrated the effect of an appropriately sized capacitor in the circuit. FIG. 6 is a wave form 40 of a half wave rectified DC supply voltage V+ with peaks 42 and valleys 44 at zero volts. There is no (or an inadequate) capacitor in this circuit. It is these valleys which cause the controller 32 to shut down and restart.

FIG. 7 shows the effect of capacitor 34. The peaks 52 now show damping effect on the rising ridge and the like damping effect on the falling ridge. Most importantly is that valley 54 now has a positive voltage (and current flow) above V=0 as illustrated by 56. The actually level of 56 depends on the size of the capacitance, draw of the controller and time. It is not likely to be flat, but have a declining slope until the next positive voltage cycle.

Though the inventive concepts have been described in detail as required by the patent law, the scope of the invention is to be interpreted broadly and not limited to the examples shown. The invention can be modified and combinations of the examples shown can be used together to create numerous variations which are considered part of this invention. The scope of the invention is defined by the claims below, and not the description, summary or drawings.

The invention claimed is:

1. An LED series connected light string comprising:

a. a plurality of LEDs connectable to an AC power source;

b. said LEDs being connected with uniform polarity;

c. at least one of said LEDs intended for twinkling, flashing or emit any light pattern or color desired and including a controller; said controller being wired to the at least one LED and which changes the current flows through LED, thereby causing its series connected LED to change color, twinkle, flash or emit a light pattern in response to switching of the controller;

d. a current supplying capacitive energy storage element connected in parallel with said controller and the LED being in series with each other; said element supplying current to said controller to maintain said controller operational and preventing it from resetting for lack of power at least for a predetermined period of time when current supplied to the circuit is reverse polarity; and e. wherein said at least one LED is mechanically removable from the light string, and wherein said current supplying element are mechanically linked and integral to each other and removable only simultaneously from the light string, such that the current supplying element is never connected to the circuit without it corresponding connected controller.

2. The circuit of claim 1 wherein said element is a capacitor.

3. The circuit of claim 1 wherein said element in an active source of current.

4. The circuit of claim 1 wherein said element is a battery.

5. The circuit of claim 1 further including a resistive shunt interposed in place of said LED is removed.

6. The circuit of claim 1 wherein said controller is connected in parallel with the LED.

7. The circuit of claim 1 wherein said controller is connected in series with the LED.

8. The circuit of claim 6 wherein said LED includes multiple LED elements of different colors and wherein said controller applies different currents to each LED elements to create different color effects.

9. The circuit of claim 7 wherein said color includes a lack of light emission in one state, and light emission in another state.

* * * * *